US007331304B2

(12) United States Patent
Erskine et al.

(10) Patent No.: US 7,331,304 B2
(45) Date of Patent: Feb. 19, 2008

(54) WINDSHIELD SYSTEM INCLUDING TOWER FRAME

(75) Inventors: Edward J. Erskine, Benson, NY (US); Robert R. Shearer, Bradenton, FL (US)

(73) Assignee: Taylor Made Group, Inc., Gloversville, NY (US)

( * ) Notice: Subject to any disclaimer, the term of this patent is extended or adjusted under 35 U.S.C. 154(b) by 57 days.

(21) Appl. No.: 11/148,222

(22) Filed: Jun. 9, 2005

(65) Prior Publication Data

US 2006/0087146 A1 Apr. 27, 2006

Related U.S. Application Data

(63) Continuation-in-part of application No. 10/971,081, filed on Oct. 25, 2004.

(51) Int. Cl.
*B63B 17/00* (2006.01)

(52) U.S. Cl. ..... 114/361; 114/242; 114/343; 403/309

(58) Field of Classification Search ..... 114/343, 114/361, 242; 403/309, 310, 311, 312, 313, 403/122, 141, 142
See application file for complete search history.

(56) References Cited

U.S. PATENT DOCUMENTS

| | | | | |
|---|---|---|---|---|
| 1,254,566 | A * | 1/1918 | Bard | 285/87 |
| 2,974,329 | A * | 3/1961 | Welch | 114/361 |
| 3,810,267 | A * | 5/1974 | Fussell et al. | 114/361 |
| 4,838,195 | A * | 6/1989 | Carter | 114/343 |
| 5,303,136 | A * | 4/1994 | Brown | 362/421 |
| 5,303,667 | A * | 4/1994 | Zirkelbach et al. | 114/361 |
| 5,979,350 | A | 11/1999 | Larson et al. | |
| D465,194 | S | 11/2002 | Eck | |
| 2003/0075097 | A1* | 4/2003 | Warfel et al. | 114/361 |
| 2004/0258460 | A1* | 12/2004 | Taylor | 403/79 |

* cited by examiner

*Primary Examiner*—Sherman Basinger
(74) *Attorney, Agent, or Firm*—Nixon & Vanderhye P.C.

(57) ABSTRACT

A windshield assembly includes a windshield frame constructed to support a windshield. A plurality of couplers are secured to the windshield frame, and a tower frame for a wakeboard tow rope or cable attachment, radar arch or the like is connected to the windshield frame via the couplers. In one arrangement, the couplers are connected to the wing sections of the windshield frame, and the tower frame extends between the wing sections and above an area defined between the wing sections. The integrated tower frame and windshield simplifies installation for the boat manufacturer while accommodating many varieties of tower and windshield configurations.

4 Claims, 4 Drawing Sheets

WINDSHIELD SYSTEM INCLUDING TOWER FRAME

CROSS-REFERENCES TO RELATED APPLICATIONS

This application is a continuation-in-part (CIP) of U.S. patent application Ser. No. 10/971,081, filed Oct. 25, 2004, pending; the entire content of which is hereby incorporated by reference in this application.

STATEMENT REGARDING FEDERALLY SPONSORED RESEARCH OR DEVELOPMENT (NOT APPLICABLE)

BACKGROUND OF THE INVENTION

The present invention relates to a windshield system and, more particularly, to a windshield system typically for a marine environment that includes an integrated tower frame for supporting a wakeboard tower or the like.

A wakeboard tower is a boat accessory typically extending above and across the passenger area over the boat windshield. The tower is designed to support a tow rope for a wakeboard rider. Typically, the wakeboard tower is comprised of tubular frame elements formed of a sturdy material such as aluminum securely fixed at four points to the boat hull. See, for example, U.S. Pat. No. D465,194 and U.S. Pat. No. 5,979,350, the contents of which are hereby incorporated by reference.

There are, however, a number of problems with existing wakeboard tower systems. In some arrangements, the wakeboard towers, once installed, are difficult to remove or are unable to be pivoted into a stowed position. With a system configured for pivotable stowage, in order to ensure proper installation, manufacturing tolerances must be tightened so that the hinge points properly align with one another. Additionally, attaching the wakeboard tower to the boat hull requires suitable connecting structure and additional labor for the boat manufacturer.

BRIEF SUMMARY OF THE INVENTION

It would thus be desirable to integrate a tower frame into a windshield system. Such structure would eliminate the need to secure the tower frame to the boat hull and would also serve to reduce manufacturing time and costs. That is, the boat manufacturer need only mount the windshield frame while the tower frame can be easily attached by the end user as an additional accessory. Additionally, with the integrated construction, there are fewer visual obstructions and a less cluttered look. A pivoting joint system for connecting the tower frame to the windshield frame enables the windshield frame to accommodate many varieties of tower configurations.

In an exemplary embodiment of the invention, a windshield assembly includes a windshield frame constructed to support a windshield, the windshield frame including a center section between two wing sections. A tower frame is coupled with the windshield frame and extends between the two wing sections and above an area defined generally within the windshield frame. The tower frame is preferably pivotable between a use position and a stowed position. In one arrangement, the tower frame is coupled with the windshield frame at four attachment points, two on each of the wing sections, wherein at least one of the attachment points on each of the wing sections is a pivot connection. The tower frame may include two U-shaped tubular members and a plurality of tubular connecting members between them. Preferably, the center section of the windshield frame is releasably coupled with the wing sections.

The windshield assembly may additionally include a tower connector attached to each of the wing sections, and a pivot coupler attached to each of the tower connectors, where the tower frame is fixed to the pivot couplers. In this context, the tower connectors may include a threaded coupling, wherein the pivot couplers are secured to the tower connectors respectively via a threaded collar engaging the threaded coupling. The tower frame may be welded to the pivot coupler, and the tower connectors may be welded to the wing sections. The tower connectors and the pivot couplers preferably define a channel for receiving wires or tubing therethrough.

The assembly may alternatively include swing couplers securing the tower connectors and the pivot couplers, respectively. The swing couplers include locking structure engaging the tower connectors and the pivot couplers. In this arrangement, the swing couplers preferably include two pivotably attached C-shaped halves sized to surround connecting portions of the tower connectors and the pivot couplers; and fixing structure that locks the swing couplers in a closed position. The fixing structure may include a swing bolt, a bolt channel, and a locking knob.

In another exemplary embodiment of the invention, a windshield assembly includes a windshield frame, a plurality of removable couplers secured to the windshield frame, and a tower frame connected to the windshield frame via the removable couplers.

In yet another exemplary embodiment of the invention, the windshield assembly includes a windshield frame with a center section and two wing sections removably attached to opposite ends of the center section, a plurality of removable pivot couplers secured to the wing sections, and a tower frame connected to the wing sections via the removable pivot couplers.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
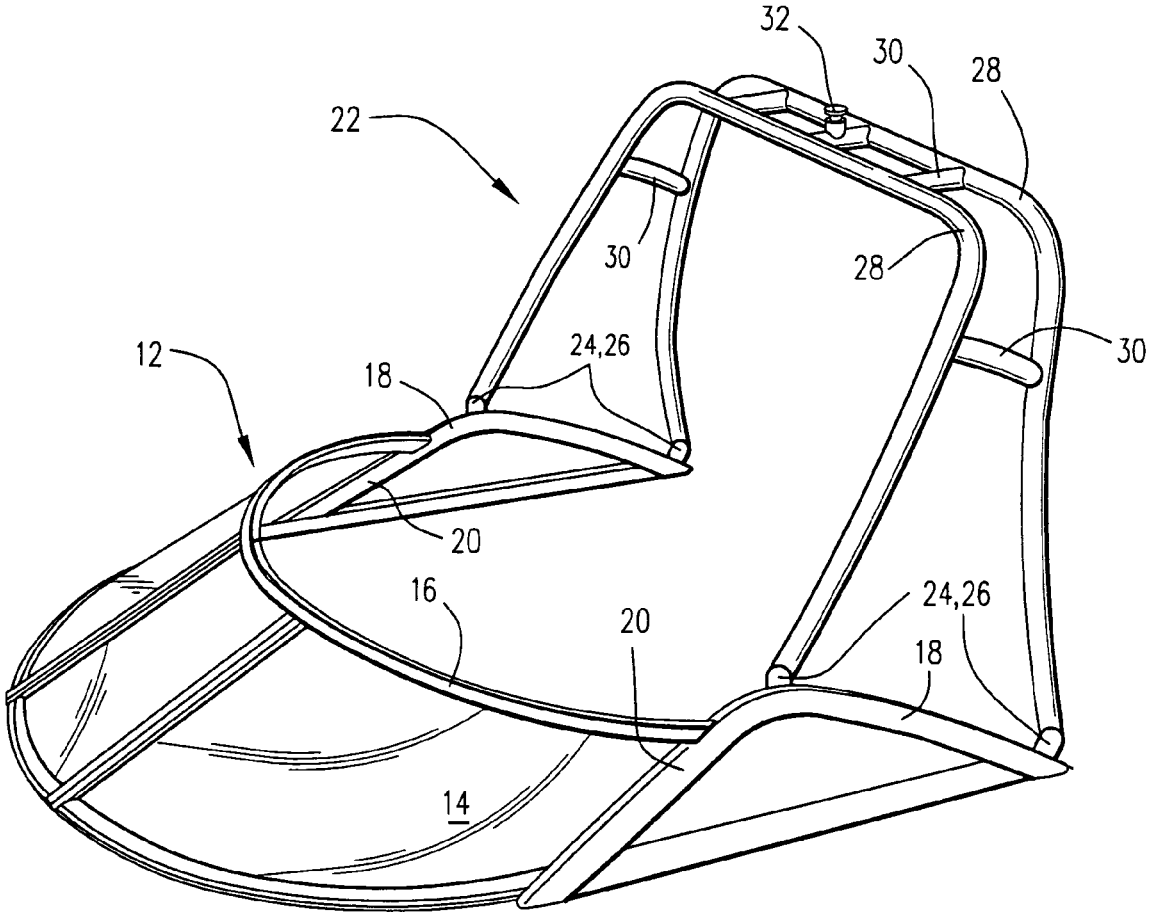
FIG. 1 is a perspective view of an exemplary configuration of a windshield assembly including an integrated tower frame according to the present invention.

FIG. 1 shows an exemplary configuration of the integrated windshield and tower frame according to the present invention. A conventional windshield construction generally includes a windshield frame 12 that is constructed to support a windshield 14 of glass or other suitable material. The windshield frame 12 may include a center section 16 that can be flat or curved (as shown) or any other suitable configuration and optionally a pair of wing sections 18. The wing sections 18 are preferably separately connectable to the center section 16 along a joint line 20 where the wing sections 18 and the center section 16 abut one another. Any suitable connecting structure may be used such as a rail and slot configuration or an abutment connection via a bolt, or the like.

A tower frame 22 is coupled with the windshield frame 12 via a plurality of tower connectors 24 and pivot couplers 26 (described in detail below). The tower frame 22 preferably extends between portions of the windshield frame 12 and generally above an area defined by the windshield frame 12. Preferably, as shown, the tower frame 22 is attached to the wing sections 18 at four attachment points, two on each of the wing sections 18. In one construction, the tower frame 22 is formed of two U-shaped tubular members 28 and a plurality of tubular connecting members 30 between them. A rope or cable attachment member 32 is attached at the top of the tower frame 22 for towing the wakeboard rider. The member 32 may alternatively be a radar arch or any other structure suited for the application.

Figure 2:
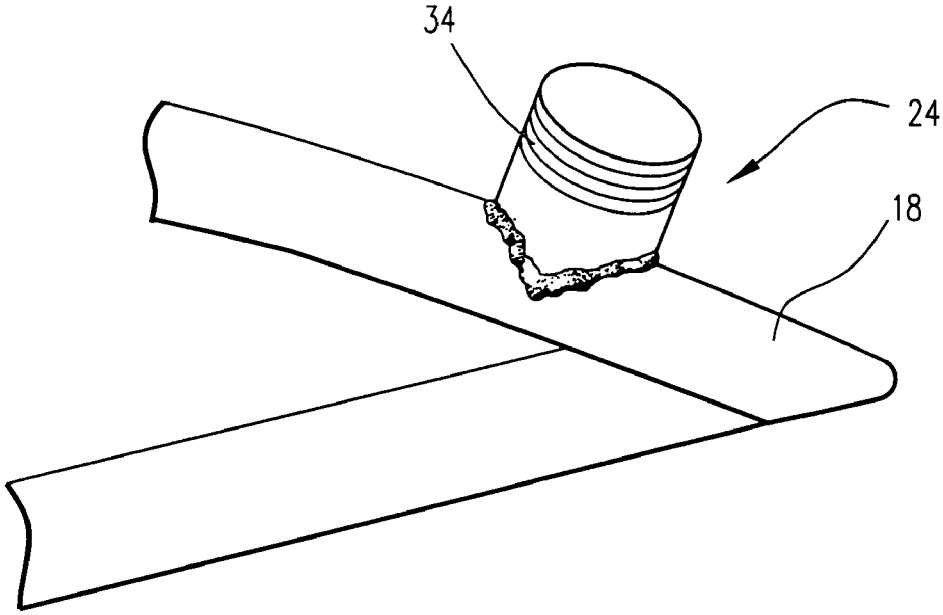
FIG. 2 shows an exemplary tower connector attached to a wing section of the windshield assembly.
Figure 3:
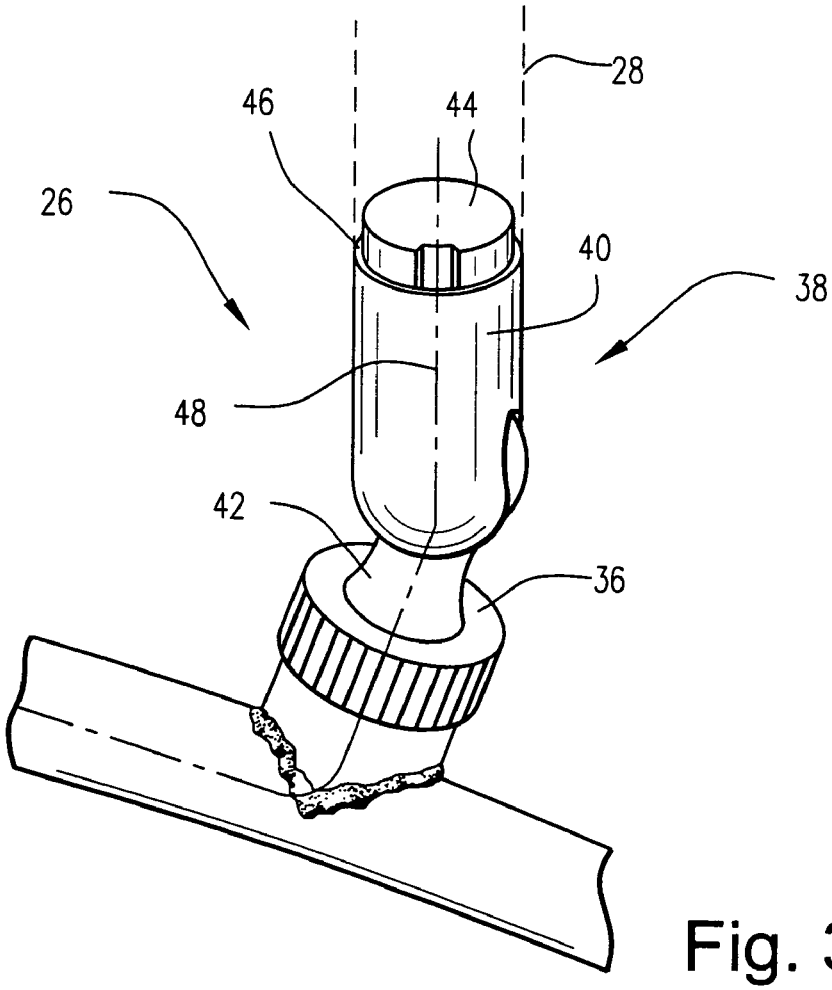
FIG. 3 shows a pivot coupler attached to the tower connector of FIG. 2.

FIGS. 2 and 3 illustrate the connecting components for securing the tower frame 22 to the windshield frame 12. In a preferred arrangement, a tower connector 24 is welded to the wing section 18. Of course, the tower connectors 24 could be attached to the wing sections 18 or center section 16 by any suitable means. The tower connectors 24 are provided with structure for releasably connecting the respective pivot couplers 26. In this context, as shown in FIG. 2, in a preferred exemplary embodiment, the tower connectors 24 are provided with external threads 34 for receiving a collar 36 of the pivot couplers 26. Decorative covers (not shown) may be provided for the tower connectors 24 when the tower frame 22 is not attached.

As described in greater detail in the above-noted parent application, the pivot couplers 26 include a ball assembly 38 to effect pivoting of a pivot member 40 relative to the ball assembly 42. The collar 36 is fit over the ball assembly 42 prior to securing the pivot member 40 in place. The pivot member 40 includes a reduced diameter section 44 defining a shoulder 46. When assembled, ends of the tubular members 28 fit over the reduced diameter section 44 on the shoulders 46 and are secured in place, e.g., by welding or the like. The tower connectors 24 and the pivot couplers 26 define a channel 48 (shown in dash dot line in FIG. 3) for receiving wires or tubing therethrough. Preferably, a hole sized for an 8-wire connector is drilled for the channel 48 into the windshield frame 18.

By virtue of the tower connectors 24 and pivot couplers 26, the tower frame 22 is readily pivotable between a use position and a stowed position. In an exemplary application, the forward pivot couplers 26 fixed to the tower frame may be released from the wing sections 18, via unscrewing the collar 36 or the like, and the tower frame 22 can be pivoted in the aft direction to the stowed position. Alternatively, the aft pivot couplers 26 may be released, and the tower frame 22 can be pivoted in an opposite direction. Of course, other types of couplers, such as non-pivoting couplers, may be used, and the invention is not necessarily meant to be limited to the illustrated structure.

Figure 4:
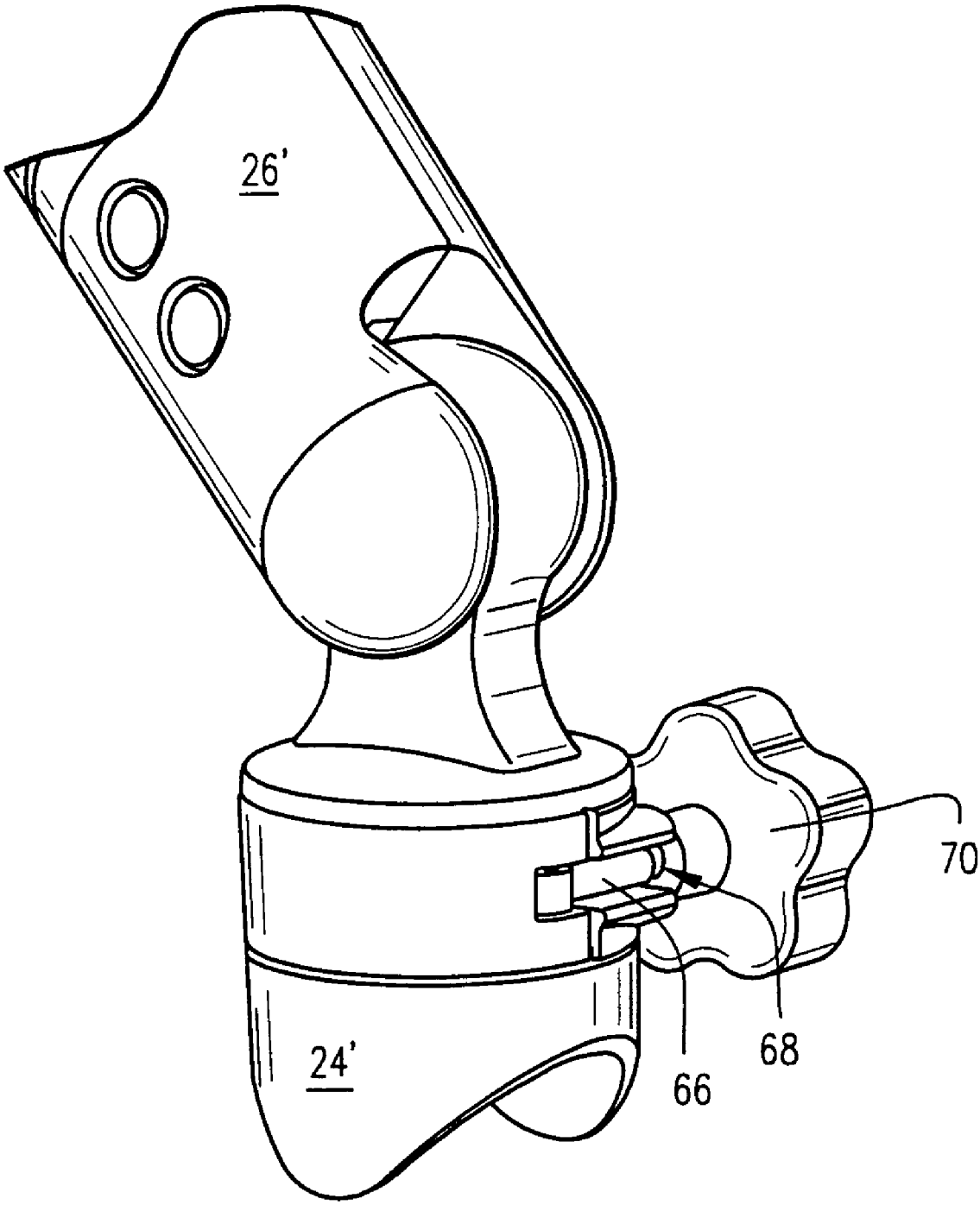
FIG. 4 illustrates an alternative assembly for securing the pivot coupler to the tower connector.
Figure 5:
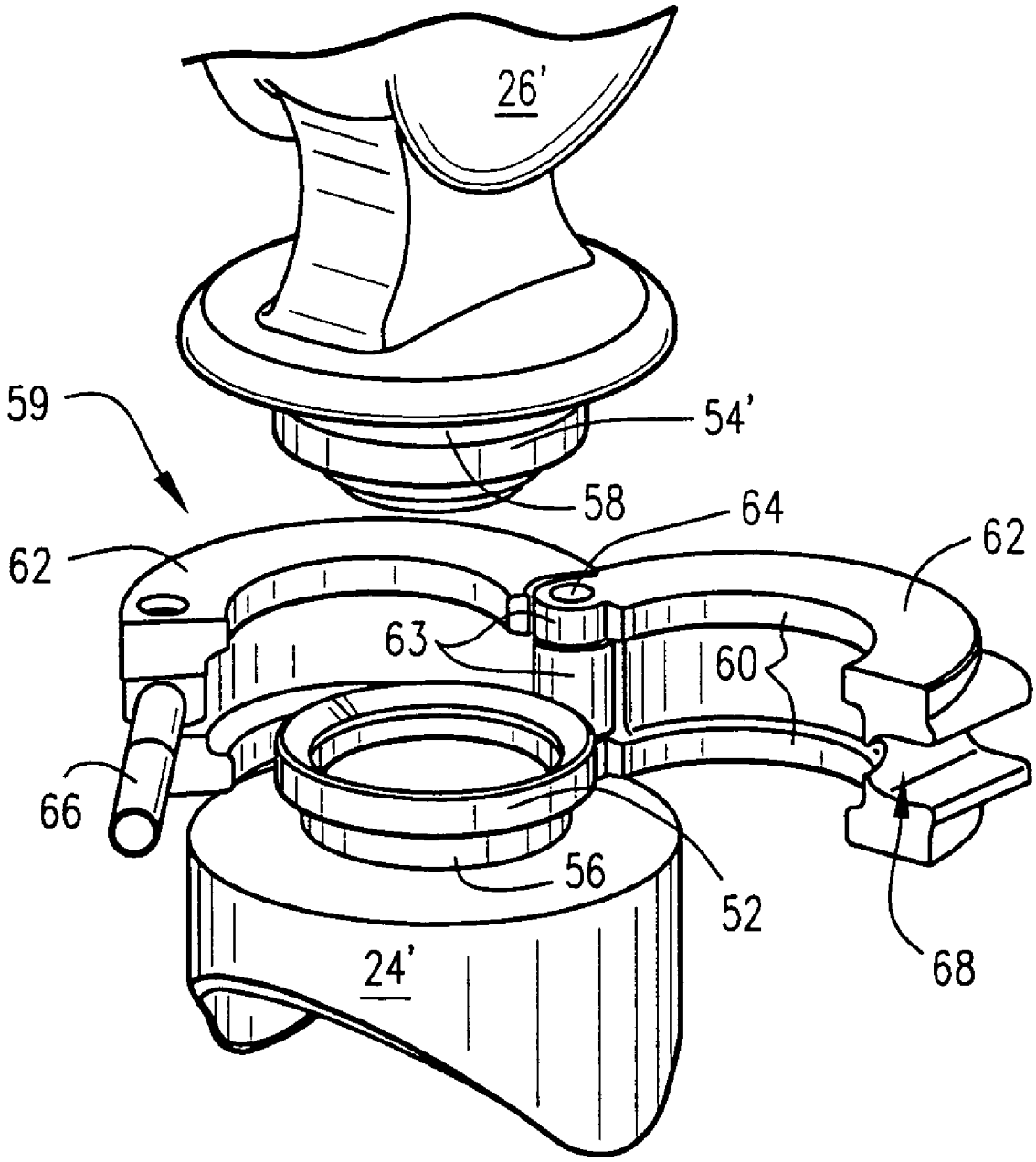
FIG. 5 shows the alternative assembly of FIG. 4 in an open state.

An alternative tower connector 24' and pivot coupler 26' are shown in FIGS. 4 and 5. In some instances, welding the threaded tower connectors 24 may cause distortion and thereby jamming of the threads 34. The alternative connectors 24' and couplers 26' obviate this potential problem and provide a different look. With reference to FIGS. 4 and 5, the tower connector 24' is provided with a coupling stub 52, and the pivot coupler 26' is provided with a coupling plug 54 that is sized to fit adjacent the coupling stub 52. The coupling stub 52 and coupling plug 54 define recessed areas 56, 58 respectively, for receiving shoulder sections 60 of a swing coupler 59.

FIG. 4 shows the swing coupler 59 in a closed position securing the tower connector 24' and the pivot coupler 26' together. The swing coupler 59 includes two C-shaped halves 62 pivotably connected at a pivot joint 63 by a pivot pin 64. The pivot pin 64 is fixed in the tower connector 24'. A swing bolt 66 is pivotably attached to an end of one of the C-shaped halves 62 opposite the pivot joint 63. A corresponding end of the other C-shaped half 62 includes a bolt channel 68 for receiving the swing bolt 66. In the closed position, the swing coupler 59 is secured to the tower connector 24' and pivot coupler 26' such that the shoulder sections 60 engage the recessed areas 56, 58 to prevent the tower connector 24' from separating from the pivot coupler 26'. The swing bolt 66 is received in the bolt channel 68, and a knob 70 is threaded on an end of the swing bolt 66 to thereby lock the swing coupler 59 in the closed position.

With the structure of the present invention, installation for the boat manufacturer can be simplified whereby only the windshield is required to be mounted while the wakeboard tower frame can be added any time as an accessory. Additionally, the construction of the invention embodies fewer visual obstructions with a less cluttered look. The joint system enables the tower frame to be pivoted while also providing a channel for accommodating wires or tubing or the like. Moreover, the multiple pivot couplers enable the construction to accommodate many varieties of tower configurations and windshield configurations. Still further, securing the tower frame to the wing sections of the windshield spreads the tower loading over a greater area of the boat. That is, with conventional arrangements, the load is concentrated on four points where the tower frame is attached to the boat hull; with the invention, the load is distributed across the windshield frame.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A windshield assembly comprising:

a windshield frame constructed to support a windshield, the windshield frame including a center section between two wing sections;

a tower frame coupled with the windshield frame, the tower frame extending between said two wing sections and above an area defined generally within said windshield frame;

a tower connector attached to each of the wing sections;

a pivot coupler attached to each of the tower connectors, the tower frame being fixed to the pivot couplers; and swing couplers securing the tower connectors and the pivot couplers, respectively, the swing couplers including locking structure engaging the tower connectors and the pivot couplers, wherein the swing couplers comprise:

two pivotably attached C-shaped halves sized to surround connecting portions of the tower connectors and the pivot couplers; and fixing structure that locks the swing couplers in a closed position.

2. A windshield assembly according to claim 1, wherein the fixing structure comprises a swing bolt, a bolt channel, and a locking knob.

3. A windshield frame comprising:

a windshield frame constructed to support a windshield, the windshield frame including a center section and two wing sections removably attached to opposite ends of the center section;

a plurality of removable pivot couplers secured to the wing sections;

a tower frame connected to the wing sections via the removable pivot couplers;

a plurality of tower connectors attached to the wing sections, wherein the removable couplers are secured to the wing sections via the tower connectors; and swing couplers securing the tower connectors and the pivot couplers, respectively, the swing couplers including locking structure engaging the tower connectors and the pivot couplers, wherein the swing couplers comprise:

two pivotably attached C-shaped halves sized to surround connecting portions of the tower connectors and the pivot couplers; and fixing structure that locks the swing couplers in a closed position.

4. A windshield frame according to claim 3, wherein the fixing structure comprises a swing bolt, a bolt channel, and a locking knob.

* * * * *